US005512016A

United States Patent [19]

Tani

[11] Patent Number: 5,512,016

[45] Date of Patent: Apr. 30, 1996

[54] COIN DELIVERING APPARATUS

[75] Inventor: Kiyoshi Tani, Saitama, Japan

[73] Assignee: Asahi Seiko Kabushiki Kaisha, Tokyo, Japan

[21] Appl. No.: 494,999

[22] Filed: Jun. 27, 1995

[30] Foreign Application Priority Data

Jun. 27, 1994 [JP] Japan ..... 6-165762

[51] Int. Cl.[6] ..... G07D 1/00

[52] U.S. Cl. ..... 453/32; 453/57

[58] Field of Search ..... 453/33, 34, 35, 453/39, 40, 42, 49, 57; 194/342, 343, 344, 345, 346

[56] References Cited

U.S. PATENT DOCUMENTS

| | | | |
|---|---|---|---|
| 4,752,274 | 6/1988 | Abe | 453/32 |
| 4,997,406 | 3/1991 | Horiguchi et al. | 453/57 |
| 5,114,381 | 5/1992 | Ueda et al. | 453/57 |
| 5,282,769 | 2/1994 | Suzukawa | 453/57 X |
| 5,306,206 | 4/1994 | Abe | 453/32 |

*Primary Examiner*—William E. Terrell
*Assistant Examiner*—Scott L. Lowe
*Attorney, Agent, or Firm*—Sughrue, Mion, Zinn, Macpeak & Seas

[57] ABSTRACT

A coin delivering apparatus includes a coin escalator having a coin passage where coins advance in a row. A gate is provided at a side wall of the coin passage for opening and closing a portion of the side wall. A coin delivering unit is further provided to deliver the coins toward an inlet of the coin passage in sequence. When the gate is closed, the coins delivered by the coin delivering unit advance into the coin passage via the inlet thereof and are forced out from an outlet of the coin passage. When the gate is opened while no coins are delivered by the coin delivering unit, the coins remaining in the coin passage are transferred by the coin delivering unit to a coin collecting opening to be discharged therethrough. On the other hand, when the gate is opened while the coins are delivered by the coin delivering unit, the coins delivered by the coin delivering unit are first transferred to the coin collecting opening to be discharged therethrough on a preferential basis prior to the coins remaining in the coin passage.

18 Claims, 5 Drawing Sheets

COIN DELIVERING APPARATUS

BACKGROUND OF THE INVENTION

1. Field of the Invention

The present invention relates to a coin delivering apparatus for delivering coins, medals, tokens or the like (hereinafter generally referred to as "coins"), for use in a money exchanger, a dispenser, a game machine or the like. More specifically, the present invention relates to a coin delivering apparatus which is capable of collecting coins remaining in the coin delivering apparatus, particularly, in a hopper or am escalator incorporated in the coin delivering apparatus.

2. Description of the Prior Art

Conventional coin delivering apparatuses of this type will be explained. FIGS. 3 and 4 are diagrams showing a coin delivering apparatus disclosed in Japanese First (unexamined) Patent Publication No. 61-281386. This coin delivering apparatus includes a hopper 101 defining a space for accommodating a plurality of coins, a cylindrical case 103 provided at a lower end of the hopper 101, an outlet hole 110 opened at a lower end portion of a circumferential wall of tile cylindrical case 103 at an upper side thereof, and an inclined base plate 102 forming a bottom of the cylindrical case 103. The coin delivering apparatus further includes a coin delivering disk 104 disposed on the base plate 102 and rotated by rotation of a motor shaft 107 of an electric motor 105 via a reduction gear unit 106, five coin guide holes 108 penetrating the coin delivering disk 104 for causing coins A to fall therethrough onto the base plate 102 and to be guided, and a coin delivering arm 109 which is provided between the base plate 102 and the coin delivering disk 104 so as to extend radially up to a circle defined by connecting substantially the centers of the coin guide holes 108. The coin delivering arm 109 is rotated due to rotation of the coin delivering disk 104 to slide the coin, which has fallen through the coin guide hole 108 onto the base plate 102, along a given rotational orbit on the base plate 102 so as to transfer it toward the outlet hole 110. The coin delivering apparatus further includes an outlet guide pin 130 which is arranged to abut the coin transferred by the coin delivering arm 109 so that the coin deviates from the rotational orbit and is guided to a side of the outlet hole 110. The coin delivering apparatus further includes an outlet guide member 111 arranged between the base plate 102 and the coin delivering disk 104 and at a downstream side of the outlet hole 110 for guiding the coin A, which has deviated from the rotational orbit due to the outlet guide pin 130, to the outlet hole 110.

A scraper (coin delivering impeller) 113 is further provided in the coin delivering apparatus. The scraper 113 has delivering vanes 112 arranged radially. The number of the vanes 112 is equal to the number (five) of the coin guide holes 108 of the coin delivering disk 104. The scraper 113 is rotated on the base plate 102 by means of the reduction gear unit 106 in synchronism with the coin delivering disk 104. The delivering vanes 112 scrape up and force out the coins, transferred by the outlet guide member 111 and the outlet guide pin 130, to the outside of the outlet hole 110 via an opening 110*a* of the outlet hole 110.

Further, in the coin delivering apparatus, an escalator 117 is fixedly and vertically arranged at an upper side of the base plate 102. Pairs of right and left guide rollers 119 are arranged in rows. The guide rollers 119 and the delivering vanes 112 of the scraper 113 cooperatively impel the coins toward an inlet 116 of the escalator 117 provided at a lower end of the escalator 117.

Each of the guide rollers 119 has a tapered surface facing downward, and the right and left guide rollers 119 in each pair are biased toward each other. The delivering vanes 112 of the scraper 113 scrape up the coins via the outlet hole 110 in cooperation with the outlet guide member 111 and force them into between the right and left paired guide rollers 119 in sequence. At this time, the coin is prevented from going upward due to the downward-facing tapered surfaces of the guide rollers 119 and advances toward the lower-end inlet 116 of the escalator 117.

Accordingly, in the conventional coin delivering apparatus, the coins forced out by the normal rotation of the coin delivering disk 104 caused by the normal rotation of the electric motor 105 are guided to the guide rollers 119 by means of the scraper 113 and then forced into the escalator 117 where the coins are pushed upward by the succeeding coins and thus advance upward arranged in a row.

However, there has been the following problem in the foregoing conventional coin delivering apparatus. Specifically, it is troublesome to take out the coins remaining in the coin delivering apparatus after finishing operations of the money exchanger, the dispenser and the like. More specifically, there has been a problem when collecting the coins remaining in the coin delivering means and the escalator incorporated in the coin delivering apparatus. For example, in order to take out the coins in the hopper, the coins in the hopper should be taken out directly by hand. Further, in order to take out the coins in the escalator, the escalator itself should be detached from the apparatus or a cover plate of the escalator should be detached. This requires much labor.

In order to solve the foregoing problem, several countermeasures have been proposed. A technique disclosed in Japanese First (unexamined) Patent Publication No. 6-114157 is one of them. FIG. 5 is a diagram showing a structure of a coin delivering apparatus disclosed in this publication. This coin delivering apparatus is constituted by two main portions, i.e. a coin transfer unit (coin delivering means) 201 and a coin travel passage (escalator) 202.

In the coin delivering apparatus of FIG. 5, a discharging mechanism 212 is provided at a lower end of a first travel passage 202*a*. The discharging mechanism 212 opens a portion of the travel passage 202 for causing the coins C remaining in the travel passage 202 to fall and to be discharged outside the travel passage 202 while the delivery of the coins C from the coin transfer unit 201 is stopped. The discharging mechanism 212 is structured such that a lower end portion 213 of one circumferential guide member 210 forming the first travel passage 202*a* is supported so as to be pivotal about a longitudinal axis X, and a thumbscrew is provided to screw this pivotal guide member 213 to a side of a plate guide member 211. Accordingly, when the thumbscrew is relaxed, the coins C remaining in the travel passage 202 forcibly cause, due to their own weight, the pivotal guide member 213 to make a pivotal motion so that a lower end of the first travel passage 202*a* is opened. Thus, all the coins C remaining in the travel passage 202 fall, by their own weight, into a collecting receptacle 215 arranged by the coin transfer unit 201, guided along an upper surface of a delivery guide member 209.

In the coin delivering apparatus of FIG. 5, speed regulating means 217 is provided for preventing the coins C from falling at a stretch. The speed regulating means 217 includes upper and lower advance/retreat members 220 and 221, which are arranged at an interval substantially equal to a diameter of the coin C. The members 220 and 221 are driven by solenoids 219, respectively, so as to individually project into the first travel passage 202*a* in a diametrical direction of the coin for preventing the remaining coins C from falling all at once. Before allowing the remaining coins C to fall and to be discharged via the discharging mechanism 212, these upper and lower advance/retreat members 220 and 221 are set to project into the first travel passage 202*a* so as to once hold the coins C remaining above the lower advance/retreat member 221. After allowing the coins C remaining below the lower advance/retreat member 221 to fall and to be discharged outside the travel passage 202 via the discharging mechanism 212, the coins C are caused to fall one by one by alternately advancing/retreating the upper and lower advance/retreat members 220 and 221. Accordingly, an upper limit of a speed of the coin C falling along the travel passage 202 can be regulated to prevent failure in operation of a photo-sensor 216 so that the number of the coins C fallen and discharged into the collecting receptacle 215 via the discharging mechanism 212 can be accurately counted.

However, in the coin delivering apparatus of the latter publication, it is still possible that the coins in the escalator accidentally fall at a stretch when the discharging mechanism 212 is opened, and thus the collected coins are scattered outside the collecting receptacle 215. Further, since it is necessary to provide an additional unit, such as, the foregoing speed regulating means, the mechanism becomes complicated and a manufacturing cost of the apparatus is increased.

SUMMARY OF THE INVENTION

Therefore, it is an object of the present invention to provide an improved coin delivering apparatus. Specifically, it is an object of the present invention to provide a coin delivering apparatus with no trouble at the time of coin collection and with a simple structure.

According to a first aspect of the present invention, a coin delivering apparatus comprises a coin escalator having therein a coin passage where coins arranged in a row can pass, the coin passage having an inlet and an outlet which is arranged at a position higher than the inlet; coin delivering means for delivering the coin to the inlet of the coin passage to push upward the coin row in the coin passage so as to force out the foremost coin in the coin row via the outlet of the coin passage; coin feeding means for feeding the coins to the coin delivering mean; a gate provided at a side wall of the coin passage for opening and closing the side wall such that, when the gate is opened, the coin passes the side wall so as to be taken outside; and a coin collecting opening provided outside the gate, wherein the coin escalator, the coin delivering means and the gate are arranged in a positional relationship such that, when the coin delivering means is operated with the gate being opened while the coin supply from the coin feeding means is stopped, the coin remaining in the coin escalator falls by its own weight in the coin escalator to reach the coin delivering means, and then is discharged, by the coin delivering means, to the coin collecting opening via the gate.

In the coin delivering apparatus according to the first aspect of the present invention, the coin delivering means is disposed between the coin collecting opening and the escalator coin passage so that the coin remaining in the coin escalator is discharged to the coin collecting opening only through the operation of the coin delivering means. Accordingly, the coins remaining in the escalator are prevented from being discharged all at once by their own weight immediately upon opening the gate.

According to a second aspect of the present invention, a coin delivering apparatus comprises a coin escalator having therein a coin passage where coins arranged in a row can pass, the coin passage having an inlet and an outlet which is arranged at a position higher than the inlet; coin delivering means for delivering the coin to the inlet of the coin passage to push upward the coin row in the coin passage so as to three out the foremost coin in the coin row via the outlet of the coin passage; coin feeding means for feeding the coins to the coin delivering mean; a gate provided at a side wall of the coin passage for opening and closing the side wall such that, when the gate is opened, the coin passes the side wall so as to be taken outside; and a coin collecting opening provided outside the gate, wherein the coin escalator, the coin delivering means, the coin feeding means and the gate are arranged in a positional relationship such that, when the coin delivering means is operated with the gate being opened while the coin supply from the coin feeding means continues, the coins supplied from the coin feeding means are discharged to the coin collecting opening via the gate on a preferential basis prior to the coins remaining in the coin escalator.

In case of performing the coin collection while the coins remain in the coin feeding means, if the coin advancing toward the coin collecting opening from within the escalator coin passage and the coin advancing toward the coin collecting opening from the coin feeding means via the coin delivering means interfere with each other at the gate or the like, this may cause the trouble of coin clogging. Accordingly, in the coin delivering apparatus according to the second aspect of the present invention, it is arranged that the coins supplied from the coin feeding means are discharged on a preferential basis prior to the coins remaining in the coin escalator.

According to a third aspect of the present invention, a coin delivering apparatus comprises a coin escalator having therein a coin passage where coins arranged in a row can pass, the coin passage having an inlet and an outlet which is arranged at a position higher than the inlet; coin delivering means for delivering the coin to the inlet of the coin passage to push upward the coin row in the coin passage so as to force out the foremost coin in the coin row via the outlet of the coin passage; coin feeding means for feeding the coins to the coin delivering mean; a gate provided at a side wall of the coin passage for opening and closing the side wall such that, when the gate is opened, the coin passes the side wall so as to be taken outside; and a coin collecting opening provided outside the gate, wherein the coin escalator, the coin delivering means and the gate are arranged in a positional relationship such that, when the coin delivering means is operated with the gate being opened while the coin supply from the coin feeding means is stopped, the coin remaining in the coin escalator falls by its own weight in the coin escalator to reach the coin delivering means, and then is discharged, by the coin delivering means, to the coin collecting opening via the gate, and wherein the coin escalator, the coin delivering means, the coin feeding means and the gate are arranged in a positional relationship such that, when the coin delivering means is operated with the gate being opened while the coin supply from the coin feeding means continues, the coins supplied from the coin feeding means are discharged to the coin collecting opening via the gate on a preferential basis prior to the coins remaining in the coin escalator.

The coin delivering apparatus according to the third aspect of the present invention is provided with both structures of the coin delivering apparatuses according to the first and second aspects so that both operations provided by the coin delivering apparatuses according to the first and second aspects can be achieved.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENT

Now, a preferred embodiment of the present invention will be described hereinbelow with reference to the accompanying drawings.

Figure 1:
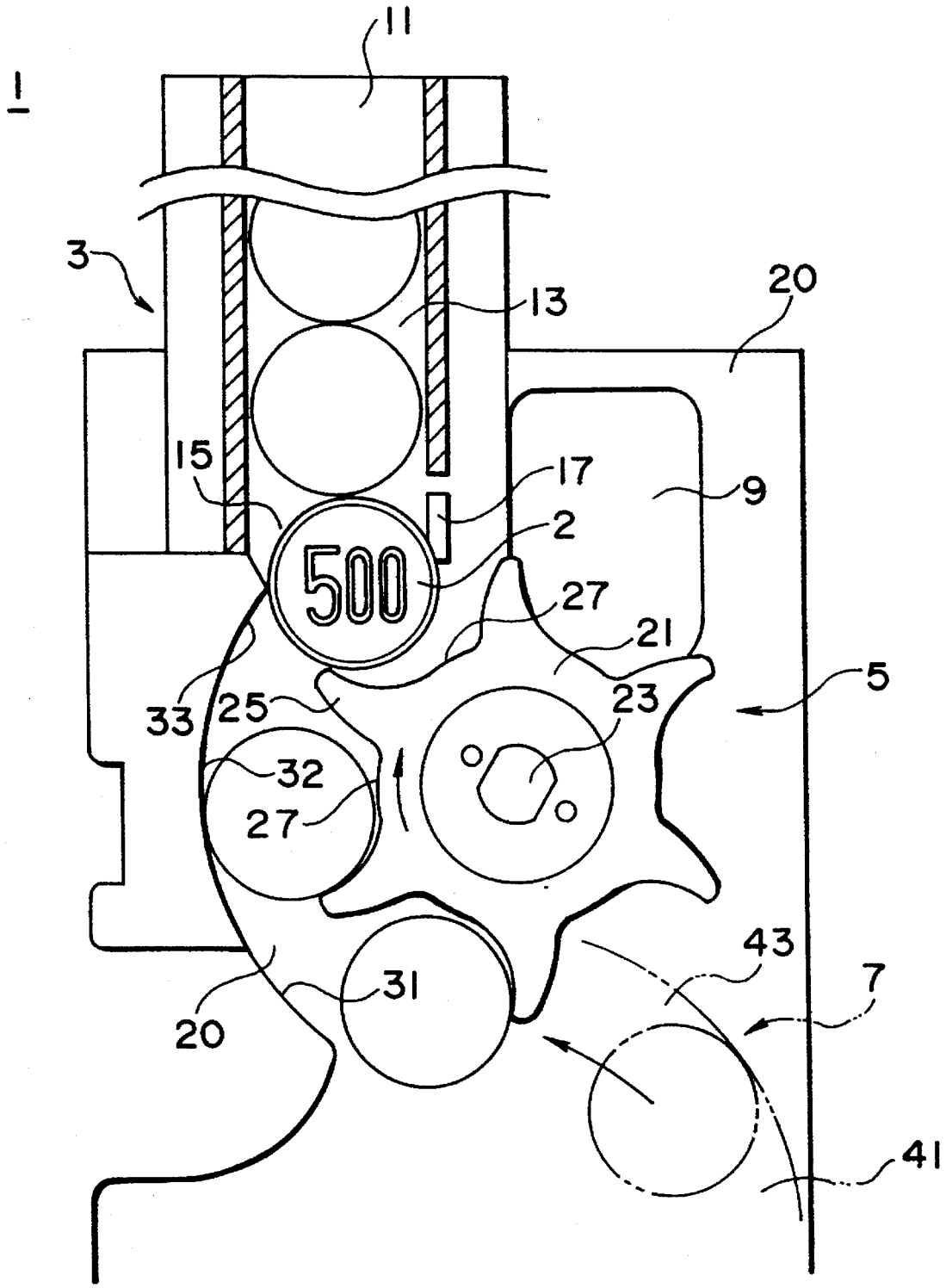
FIG. 1 is a diagram showing a main portion of a coin delivering apparatus according to a preferred embodiment of the present invention.

FIG. 1 is a diagram showing a main portion of a coin delivering apparatus according to the preferred embodiment of the present invention. The coin delivering apparatus 1 is constituted by main parts, such as, an escalator 3, coin delivering means 5 and coin feeding means 7.

Figure 3:
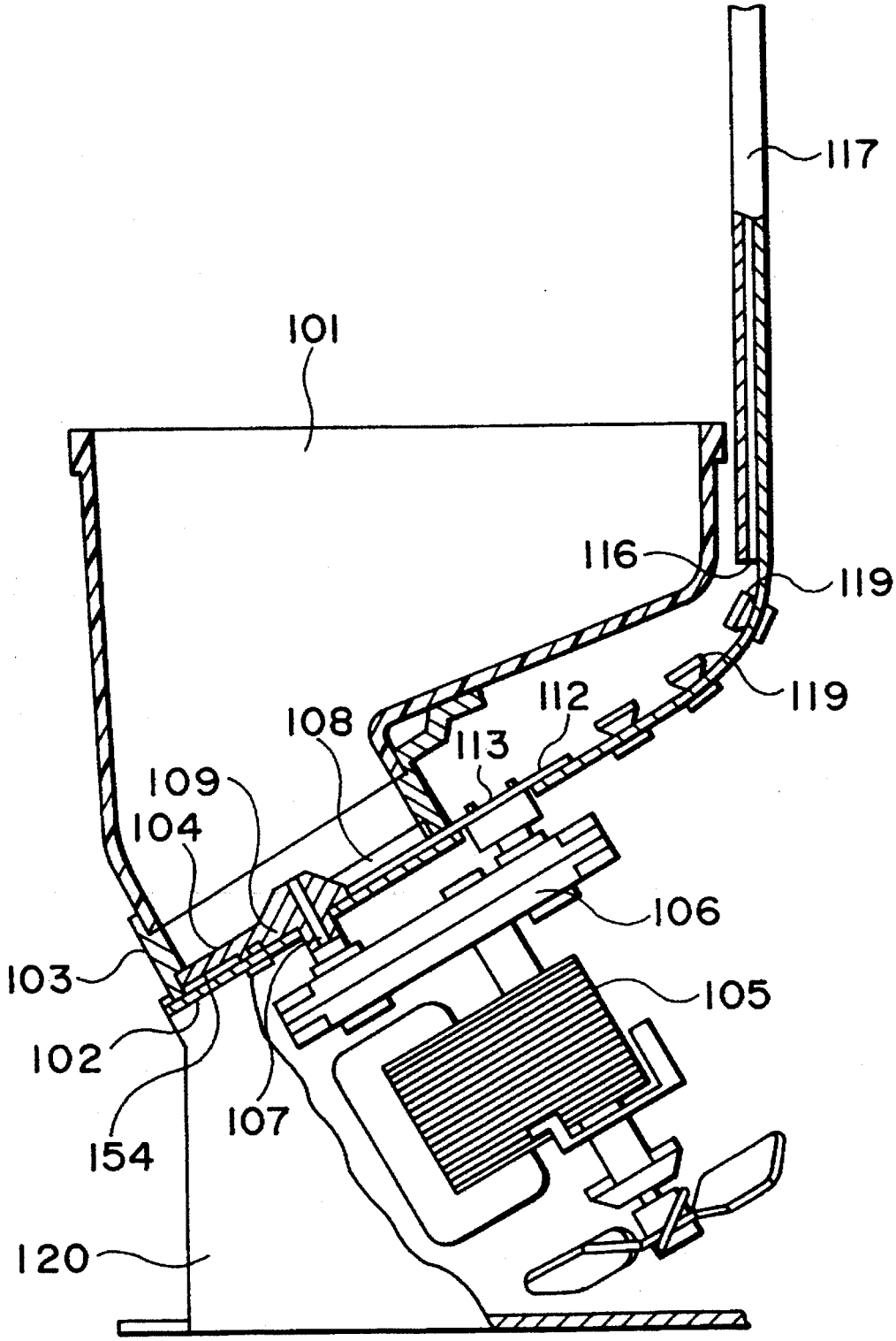
FIG. 3 PRIOR ART
FIG. 3 is a side sectional view showing a structure of a conventional coin delivering apparatus with an escalator.
Figure 4:
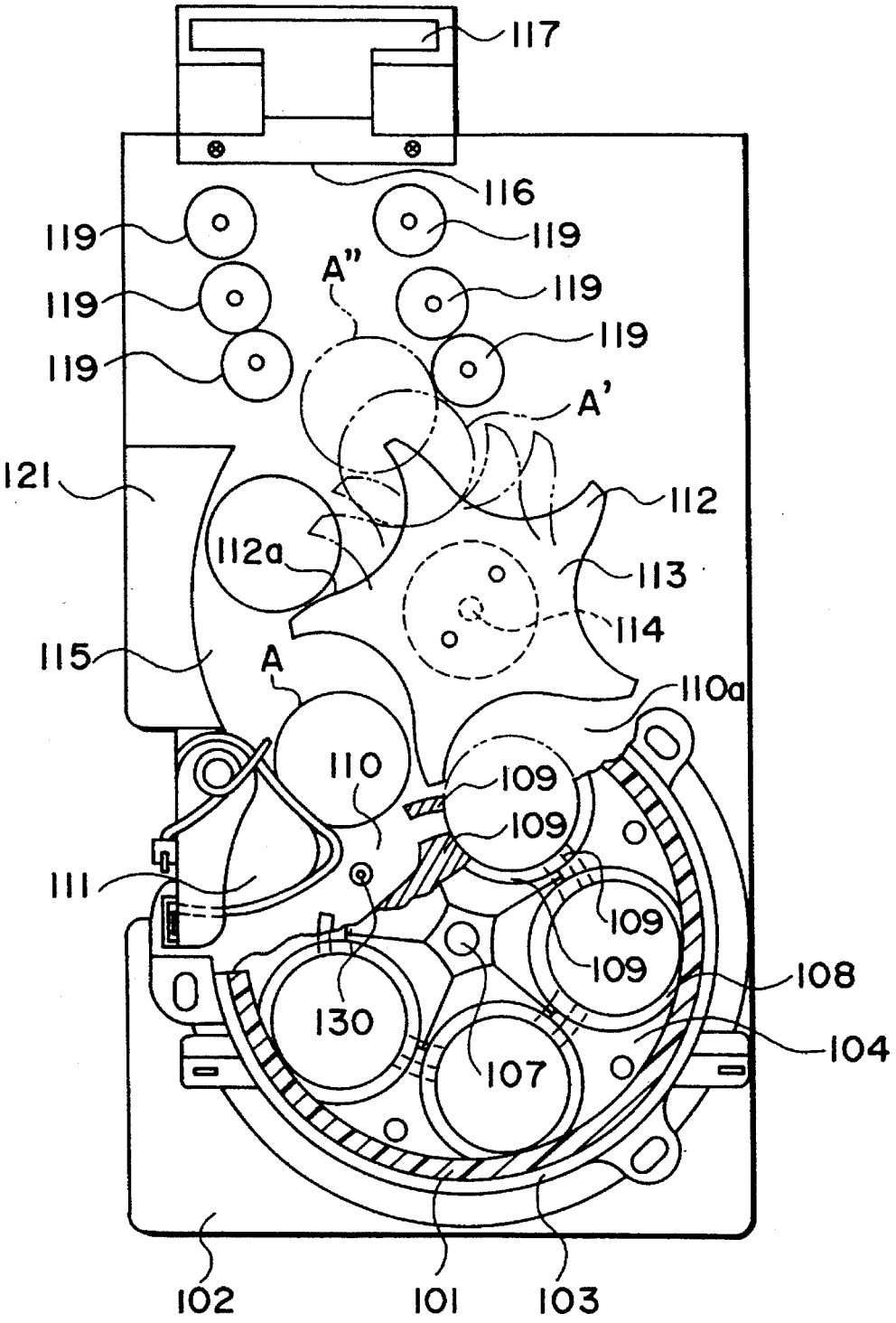
FIG. 4 PRIOR ART
FIG. 4 is a partly-sectioned top plan view of the coin delivering apparatus shown in FIG. 3.
Figure 5:
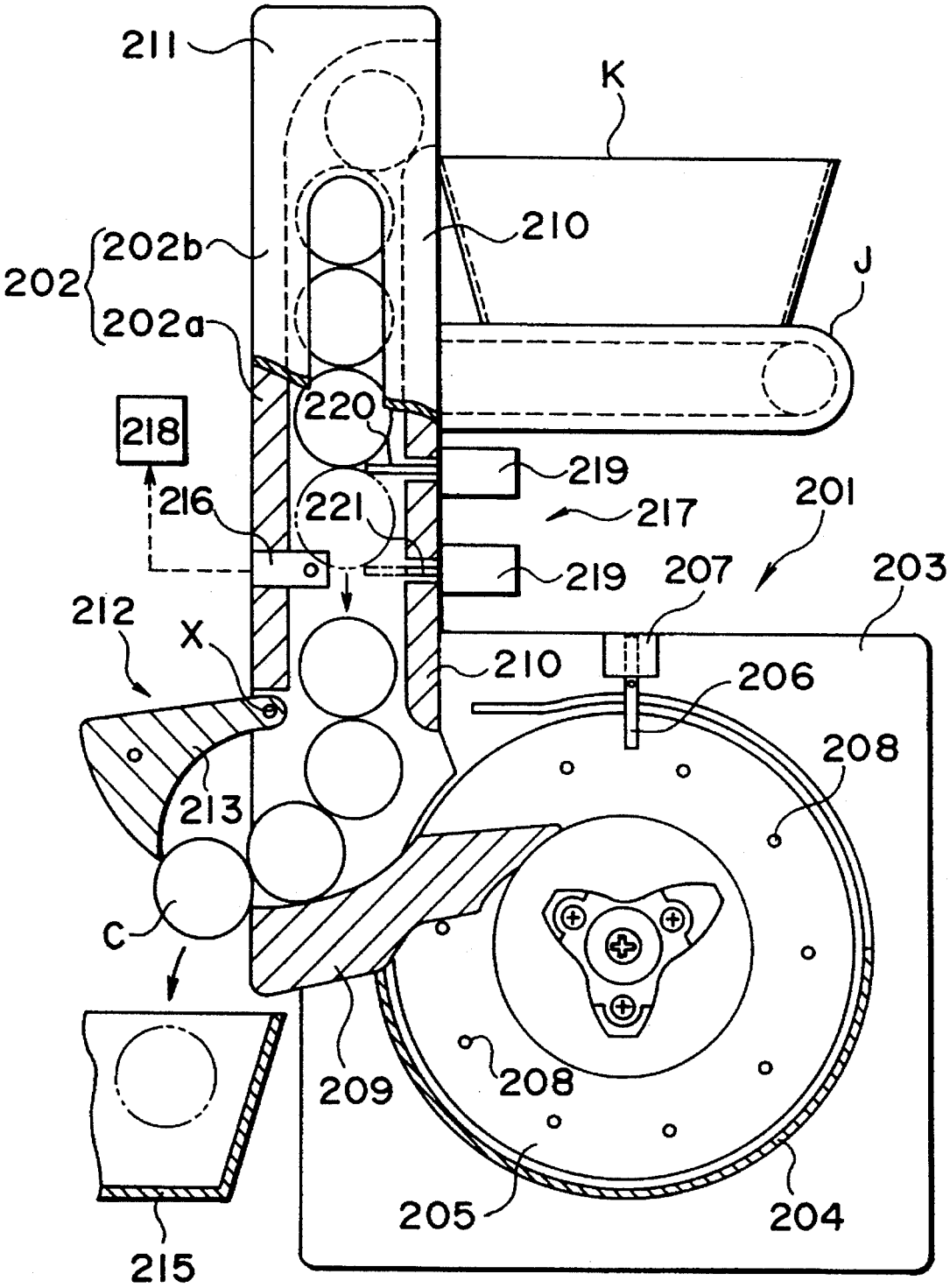
FIG. 5 PRIOR ART
FIG. 5 is a diagram showing a structure of another conventional coin delivering apparatus.

The basic function of the escalator 3 of the coin delivering apparatus 1 shown in FIG. 1 is the same as those of the escalators of the conventional coin delivering apparatuses shown in FIGS. 3, 4 and 5. In a coin passage 13 formed in the escalator 3, the coins are transferred upward as being arranged in a row (with one coin in a thickness direction). The coins transferred upward are discharged via an outlet 11 of the coin passage 13 into a hopper or the like. An inlet 15 of the coin passage 13 is an opening having such a size as to allow the coins to pass therethrough one by one. Into the inlet 15, coins are newly delivered via the coin delivering means 5. The newly-delivered coin pushes upward the coin row as a whole within the coin passage 13. A gate 17 is provided at a side wall of the coin passage 13 near the inlet 15, which will be described later in detail.

The coin delivering means 5 is provided at a lower side of the escalator 3. The coin delivering means 5 includes a base plate 20 on which the coins slide, a coin delivering impeller 21 which rotates on the base plate 20 and has a plurality of claws 25 each for abutment with a side surface of the coin so as to transfer the coin in a rotational direction and coin receiving pockets 27 formed between the adjacent claws 25, and a coin guide having an inlet-side guide portion 31, a center guide portion 32 and an outlet-side guide portion 33 for guiding the transferred coins.

The coin delivering impeller 21 is a rotary plate having a shape like a starfish with six legs. The coin delivering impeller 21 is driven by a shaft 23 coupled to the reduction gear unit 106 and the electric motor 105 (see FIG. 3). A position of the shaft 23 deviates rightward (in FIG. 1) from a longitudinal center line of the coin passage 13 of the escalator 3. The claws 25 project outward, while the pockets 27 are concave toward the shaft 23. Each pocket 27 is arranged to receive one coin.

On the left of the coin delivering impeller 21 is provided the coin guide (inlet-side guide portion 31, center guide portion 32, outlet-side guide portion 33) of an arc shape having its center substantially at the shaft 23 of the coin delivering impeller 21. The arc-shaped guide guides a left-side surface of the coin. Specifically, the coin which enters the pocket 27 of the coin delivering impeller 21 substantially just under the coin delivering impeller 21 from the coin feeding means 7, is pushed by the claw 25 rotating in a clockwise direction to advance upward along the base plate 20, guided by the arc-shaped guide.

On an upper-left side of the coin delivering impeller 21, the coin pushed by the claw 25 abuts the gate 17 (when closed) at its upper-right side surface. At this time, when delivering the coin into the inlet 15 of the escalator 3, the coin delivering means 5 delivers the coin while pressing it against the closed gate 17. Specifically, just under the inlet 15 of the escalator coin passage 13, the coin delivering impeller 21 is arranged to make a rotational motion having a velocity component in an upward direction and a velocity component toward the gate 17. Accordingly, when the gate 17 is closed, the coins advance in the coin passage 13 of the escalator 3 while being pushed upward. An operation of the coin delivering apparatus while the gate 17 is opened, will be described later.

Under the coin delivering impeller 21 is provided the coin feeding means 7. The coin feeding means 7 includes a coin hopper provided on the base plate 20, and a coin delivering disk 41 which is provided at a bottom of the coin hopper and rotates on the base plate. The coin delivering disk 41 has coin guide holes 43 each for receiving and guiding the coins in a flat stacked manner, and feeds the lowermost coins in the coin guide holes one by one so as to be engaged with the coin delivering claws 25 of the coin delivering means 5. This arrangement is effective for suppressing an occurrence of coin clogging. Particularly, in this preferred embodiment where the escalator 3 and a coin collecting opening 9 (which will be described hereinbelow) are provided, since the resistance load in a coin delivering direction becomes large, the foregoing combination of the coin feeding means 7 and the coin delivering means 5 is preferable.

Next, a detailed structure of the gate 17 and the coin collecting opening 9 will be described.

Figure 2:
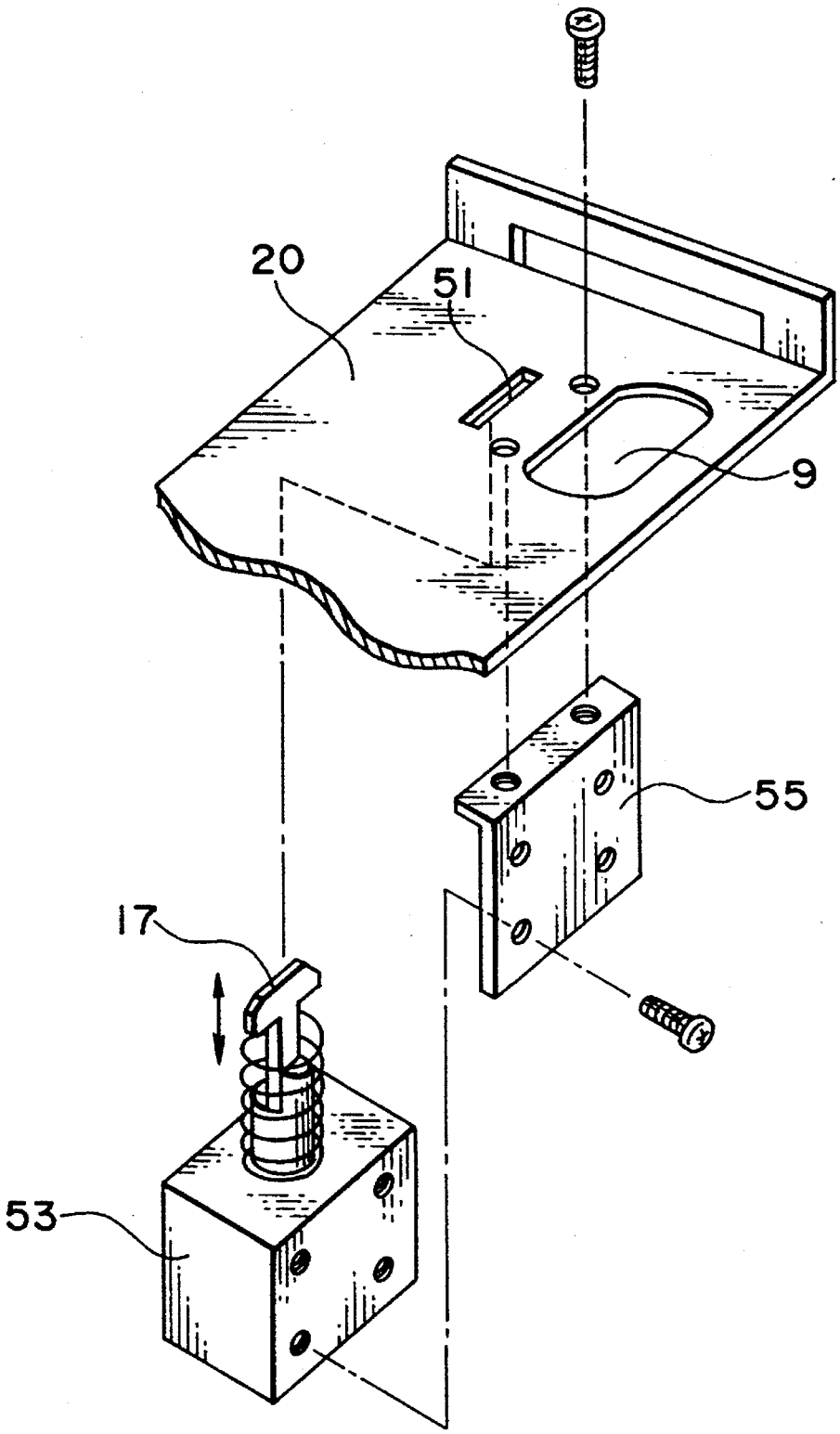
FIG. 2 is an exploded perspective view showing a structure around a gate of the coin delivering apparatus shown in FIG. 1.

FIG. 2 is an exploded perspective view showing a structure around the gate 17 of the coin delivering apparatus shown in FIG. 1. The base plate 20 (which, in practice, is set to be inclined at about 45°) is formed with a gate in-out hole 51 through which the gate 17 goes in (appear) and out (disappear). The gate 17 is driven by gate driving means 53, such as, a solenoid. The gate driving means 53 is mounted onto the base plate 20 via a mounting plate 55. Adjacent to the gate in-out hole 51, the coin collecting opening 9 is formed through the base plate 20. When the gate 17 is opened (disappear), the coins passing the gate 17 are introduced to the coin collecting opening 9 and fall therethrough to be discharged.

Returning to FIG. 1, the operation of the coin delivering apparatus 1 while the gate 17 is opened, will be described. When the gate 17 is opened (disappear under the base plate 20), the coin received in the pocket 27 of the coin delivering impeller 21 and transferred due to rotation of the coin delivering impeller 21 is not prevented by the gate 17 from advancing. Accordingly, the coin, as being received in the pocket 27, passes over the coin delivering impeller 21 and advances outside, that is, toward the coin collecting opening 9, without going into the coin passage 13. Then, the coin falls through the coin collecting opening 9 to be discharged.

At this time, if no coins are supplied to the pockets 27 of the coin delivering impeller 21 from the coin feeding means 7, that is, when there are no coins in the hopper and the coin guide holes 43 of the coin delivering disk 41, the vacant pocket 27 turns to come just under the coin passage 13 of the escalator 3. At this time, the lowermost coin of the coin row within the coin passage 13 falls to enter the pocket 27 and then goes outside, i.e. toward the coin collecting opening 9, along with rotation of the coin delivering impeller 21 to fall below the base plate 20 through the coin collecting opening 9.

On the other hand, as long as the coin supply from the coin feeding means 7 continues, there is no such an occurrence that the vacant pocket 27 comes under the coin passage 13. Accordingly, the coins remaining in the coin passage 13 of the escalator 3 are prevented from being discharged through the coin collecting opening 9. As a result, when the normal operation of the coin delivering apparatus is stopped while the coins remain in the coin delivering apparatus, and switched to the coin discharging operation (gate opened), the coins in the coin delivering means 5, the coin feeding means 7 and the hopper are first all discharged one by one through the coin collecting opening 9. Thereafter, the coins remaining in the coin passage 13 of the escalator 3 are discharged one by one through the coin collecting opening 9. Accordingly, failure to collect the coins in the hopper is prevented, and further, the coins in the escalator are prevented from coming out all at once to be scattered.

As appreciated from the foregoing description, since the coins in the escalator are prevented from coming out all at once through the coin collecting opening, scattering of the coins at the coin collecting opening can be effectively avoided. Further, since the rapid self-weight falling of the coins in the escalator does not occur, no such means is necessary for adjusting the falling speed of the coins.

It is to be understood that this invention is not to be limited to the preferred embodiments and modifications described above, and that various changes and modifications may be made without departing from the spirit and scope of the invention as defined in the appended claims.

What is claimed is:

1. A coin delivering apparatus comprising:

a coin escalator having therein a coin passage where coins arranged in a row can pass, said coin passage having an inlet and an outlet which is arranged at a position higher than said inlet;

coin delivering means for delivering coins to the inlet of said coin passage to push upward a coin row in said coin passage so as to force out a foremost coin in the coin row via the outlet of the coin passage;

coin feeding means for feeding coins to said coin delivering means;

a gate provided at a side wall of said coin passage for opening and closing said side wall such that, when the gate is opened, a coin passes said side wall so as to be taken outside of the coin passage; and a coin collecting opening provided outside said gate, wherein said coin escalator, said coin delivering means and said gate are arranged in a positional relationship such that, when said coin delivering means is operated with said gate being opened while feeding of coins from said coin feeding means stops, coins remaining in the coin escalator fall by their own weight in the coin escalator to reach said coin delivering means, and then are discharged one by one, by said coin delivering means, to said coin collecting opening via said gate.

2. The coin delivering apparatus according to claim 1, wherein said gate is provided at a side wall of the coin passage near said inlet, and wherein said coin delivering means, when delivering the coin into said inlet, delivers the coin while pressing the coin against said gate in a closed state.

3. The coin delivering apparatus according to claim 1, wherein said coin delivering means includes:

a base plate on which coins slide;

a coin delivering impeller which rotates on said base plate, said coin delivering impeller having a plurality of claws each for abutment with a side surface of a coin so as to transfer the coin in a rotational direction and coin receiving pockets arranged between the adjacent claws; and a coin guide for guiding the transferred coin.

4. The coin delivering apparatus according to claim 3, wherein said coin feeding means includes:

a coin hopper provided on said base plate; and a coin delivering disk which is provided at a bottom of said coin hopper and rotates on said base plate, said coin delivering disk having a coin guide hole for guiding coins in a flat stacked manner, said coin delivering disk feeding the lowermost coin in the coin guide hole one by one so as to be engaged with one of said plurality of claws of said coin delivering impeller.

5. The coin delivering apparatus according to claim 3, wherein said gate is provided at a side wall of the coin passage near said inlet, and wherein said coin delivering means is arranged such that, when delivering the coin into said inlet, the coin delivering impeller makes a rotational motion, adjacent said inlet, having a velocity component along a longitudinal direction of said coin passage and a velocity component toward said gate.

6. The coin delivering apparatus according to claim 5, wherein said gate is capable of alternatively projecting above and recessing into said base plate.

7. A coin delivering apparatus comprising:

a coin escalator having therein a coin passage where coins arranged in a row can pass, said coin passage having an inlet and an outlet which is arranged at a position higher than said inlet;

coin delivering means for delivering coins to the inlet of said coin passage to push upward a coin row in said coin passage so as to force out a foremost coin in the coin row via the outlet of the coin passage;

coin feeding means for feeding coins to said coin delivering means;

a gate provided at a side wall of said coin passage for opening and closing said side wall such that, when the gate is opened, a coin passes said side wall so as to be taken outside of the coin passage; and a coin collecting opening provided outside said gate, wherein said coin escalator, said coin delivering means, said coin feeding means and said gate are arranged in a positional relationship such that, when said coin delivering means is operated with said gate being opened while feeding of coins from said coin feeding means continues, the coins fed from the coin feeding means are discharged to said coin collecting opening via said gate on a preferential basis prior to any coins remaining in the coin escalator.

8. The coin delivering apparatus according to claim 7, wherein said gate is provided at a side wall of the coin passage near said inlet, and wherein said coin delivering means, when delivering the coin into said inlet, delivers the coin while pressing the coin against said gate in a closed state.

9. The coin delivering apparatus according to claim 7, wherein said coin delivering means includes:

a base plate on which coins slide;

a coin delivering impeller which rotates on said base plate, said coin delivering impeller having a plurality of claws each for abutment with a side surface of a coin so as to transfer the coin in a rotational direction and coin receiving pockets arranged between the adjacent claws; and a coin guide for guiding the transferred coin.

10. The coin delivering apparatus according to claim 9, wherein said coin feeding means includes:

a coin hopper provided on said base plate; and a coin delivering disk which is provided at a bottom of said coin hopper and rotates on said base plate, said coin delivering disk having a coin guide hole for guiding coins in a flat stacked manner, said coin delivering disk feeding the lowermost coin in the coin guide hole one by one so as to be engaged with one of said plurality of claws of said coin delivering impeller.

11. The coin delivering apparatus according to claim 9, wherein said gate is provided at a side wall of the coin passage near said inlet, and wherein said coin delivering means is arranged such that, when delivering the coin into said inlet, the coin delivering impeller makes a rotational motion, adjacent said inlet, having a velocity component along a longitudinal direction of said coin passage and a velocity component toward said gate.

12. The coin delivering apparatus according to claim 11, wherein said gate is capable of alternatively projecting above and recessing into said base plate.

13. A coin delivering apparatus comprising:

a coin escalator having therein a coin passage where coins arranged in a row can pass, said coin passage having an inlet and an outlet which is arranged at a position higher than said inlet;

coin delivering means for delivering coins to the inlet of said coin passage to push upward a coin row in said coin passage so as to force out a foremost coin in the coin row via the outlet of the coin passage;

coin feeding means for feeding coins to said coin delivering means;

a gate provided at a side wall of said coin passage for opening and closing said side wall such that, when the gate is opened, a coin passes said side wall so as to be taken outside of the coin passage; and a coin collecting opening provided outside said gate, wherein said coin escalator, said coin delivering means and said gate are arranged in a positional relationship such that, when said coin delivering means is operated with said gate being opened while feeding of coins from said coin feeding means stops, coins remaining in the coin escalator fall by their own weight in the coin escalator to reach said coin delivering means, and then are discharged one by one, by said coin delivering means, to said coin collecting opening via said gate, and wherein said coin escalator, said coin delivering means, said coin feeding means and said gate are arranged in a positional relationship such that, when said coin delivering means is operated with said gate being opened while feeding of coins from said coin feeding means continues, the coins fed from the coin feeding means are discharged to said coin collecting opening via said gate on a preferential basis prior to any coins remaining in the coin escalator.

14. The coin delivering apparatus according to claim 13, wherein said gate is provided at a side wall of the coin passage near said inlet, and wherein said coin delivering means, when delivering the coin into said inlet, delivers the coin while pressing the coin against said gate in a closed state.

15. The coin delivering apparatus according to claim 13, wherein said coin delivering means includes:

a base plate on which the coins slide;

a coin delivering impeller which rotates on said base plate, said coin delivering impeller having a plurality of claws each for abutment with a side surface of a coin so as to transfer the coin in a rotational direction and coin receiving pockets arranged between the adjacent claws; and a coin guide for guiding the transferred coin.

16. The coin delivering apparatus according to claim 15, wherein said coin feeding means includes:

a coin hopper provided on said base plate; and a coin delivering disk which is provided at a bottom of said coin hopper and rotates on said base plate, said coin delivering disk having a coin guide hole for guiding coins in a flat stacked manner, said coin delivering disk feeding the lowermost coin in the coin guide hole one by one so as to be engaged with one of said plurality of claws of said coin delivering impeller.

17. The coin delivering apparatus according to claim 15, wherein said gate is provided at a side wall of the coin passage near said inlet, and wherein said coin delivering means is arranged such that, when delivering the coin into said inlet, the coin delivering impeller makes a rotational motion, adjacent said inlet, having a velocity component along a longitudinal direction of said coin passage and a velocity component toward said gate.

18. The coin delivering apparatus according to claim 17, wherein said gate is capable of alternatively projecting above and recessing into said base plate.

* * * * *